US006467638B2

(12) United States Patent
Gzybowski et al.

(10) Patent No.: US 6,467,638 B2
(45) **Date of Patent: *Oct. 22, 2002**

(54) EASY OPENING CLOSURE WITH STRIPPABLE STRUCTURE

(76) Inventors: Michael S. Gzybowski, P.O. Box 13381, Fort Wayne, IN (US) 46868-3381; Donald G. Rose, 418 Peachtree La., Paso Robles, CA (US) 93446

( * ) Notice: Subject to any disclaimer, the term of this patent is extended or adjusted under 35 U.S.C. 154(b) by 0 days.

This patent is subject to a terminal disclaimer.

(21) Appl. No.: 10/021,968

(22) Filed: Dec. 13, 2001

(65) Prior Publication Data

US 2002/0040882 A1 Apr. 11, 2002

Related U.S. Application Data

(63) Continuation of application No. 09/179,301, filed on Oct. 27, 1998.

(51) Int. Cl.[7] ..... B65D 39/00

(52) U.S. Cl. ..... 215/364; 215/254; 215/355; 215/296; 215/256

(58) Field of Search ..... 215/364, 362, 215/358, 355, 250, 255, 254, 251, 256, 309, 296, 295, 298–300, 306; 220/265, 266, 258.1, 258.2, 258.3, 270, 257.1, 257.2; 277/528, 527, 610, 633

(56) References Cited

U.S. PATENT DOCUMENTS

| | | | | |
|---|---|---|---|---|
| 563,445 | A | 7/1896 | Bryant | |
| 2,677,459 | A | 5/1954 | Ritzenberg | |
| 3,034,680 | A | 5/1962 | Steinberg | |
| 3,442,518 | A | 5/1969 | Henshaw | |
| 3,515,798 | A | 6/1970 | Slevert | |
| 4,179,320 | A | 12/1979 | Midgley et al. | |
| 4,474,302 | A | 10/1984 | Goldberg et al. | |
| 4,503,105 | A | 3/1985 | Tomioka | |
| 4,512,486 | A | 4/1985 | Kobayashi et al. | |
| 4,682,702 | A | 7/1987 | Gach | |
| 4,706,837 | A | 11/1987 | Cooke | |
| 4,819,819 | A | 4/1989 | Robertson, Jr. | |
| 5,048,706 | A | 9/1991 | De Vaujany | |
| 5,560,969 | A | 10/1996 | Portas | |
| 5,741,015 | A | 4/1998 | Skinner | |
| 5,915,585 | A | 6/1999 | Ladina et al. | |
| 5,944,929 | A | 8/1999 | Vallauri et al. | |
| 6,378,716 | B1 * | 4/2002 | Gzybowski et al. | 215/254 |

FOREIGN PATENT DOCUMENTS

| | | |
|---|---|---|
| FR | 2443976 | 7/1980 |

* cited by examiner

*Primary Examiner*—Lee Young
*Assistant Examiner*—Robin A. Hylton
(74) *Attorney, Agent, or Firm*—Michael S. Gzybowski

(57) ABSTRACT

A closure for receptacles such as bottles which includes an annular sealing member which is internally reinforced by a cylindrical core. The cylindrical core includes a helically or spirally shaped frangible structure along which the cylindrical core can be pulled, stripped, unwound or torn apart. The closures can be pressed into receptacles using conventional methods. To remove the closures, one pulls, strips or tears the cylindrical core apart. The remaining, unreinforced annular sealing member can be easily removed.

17 Claims, 2 Drawing Sheets

EASY OPENING CLOSURE WITH STRIPPABLE STRUCTURE

RELATED APPLICATION

This application is a Continuation of U.S. patent application Ser. No. 09/179,301, filed Oct. 27, 1998 to which priority is claimed under 35 U.S.C. §120.

TECHNICAL FIELD

The present invention is directed to closures for receptacles and containers. More particularly, the present invention is directed to closures for receptacles and containers which seal the contents thereof and which closures can be easily removed without the use of auxiliary tools.

BACKGROUND ART

Various materials are often stored in receptacles and containers in a sealed manner using closures such as caps, stoppers, corks, plugs, etc. In order to access the contents of such receptacles or containers, the closures have to be removed or transgressed. In the case of threaded or "screw-off" caps, one merely has to grasp and unscrew the cap. Closures such as corks are typically removed using a corkscrew or a similar device.

The present invention provides closures for receptacles or containers which can be easily removed without the use of auxiliary tools.

DISCLOSURE OF THE INVENTION

According to other features, characteristics, embodiments and alternatives, the present invention provides a closure for receptacles which includes:

a cylindrical core member which comprises a helically or spirally wound web member that can be stripped apart by pulling an end thereof; and an annular sealing member which surrounds the cylindrical core member.

The present invention further provides a closure for receptacles which includes:

an annular sealing member; and a strippable core member which is provided within the annular sealing member.

The present invention further provides a method of removing a closure from a receptacle which involves:

providing a receptacle which is sealed with a closure having a strippable core member and an annular sealing member;

pulling the strippable core member apart in a helically or spiral manner to form an elongate web which is removed from the receptacle; and pulling the annular sealing member from the receptacle.

BRIEF DESCRIPTION OF DRAWINGS

The present invention will be described hereafter with reference to the attached drawings which are given by way of non-limiting examples only, in which.

BEST MODE FOR CARRYING OUT THE INVENTION

Figure 1:
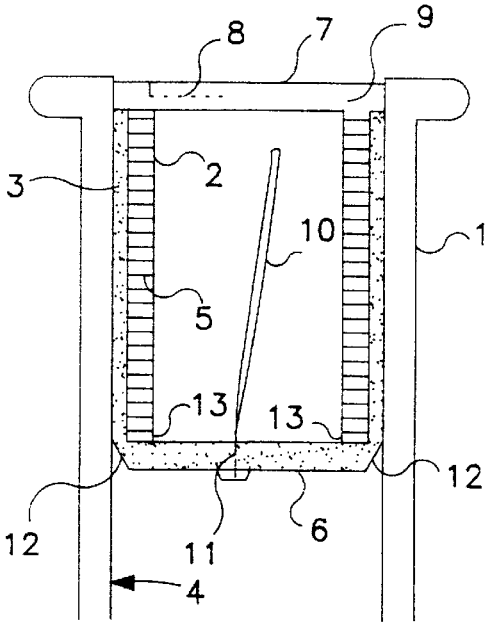
FIG. 1 is a cross-sectional view of a closure according to one embodiment of the present invention.

The present invention is directed to closures for receptacles and containers which seal the contents thereof and which closures can be easily removed without the use of auxiliary tools. The closures of the present invention are designed to lose their structural integrity and thereby be removable from a receptacle or container.

The closures of the present invention include cylindrical core members which radially support various annular sealing members. The cylindrical core members comprise strippable or tearable structures that can be pulled apart in a helical or spiral manner. According to one embodiment, the cylindrical core members can be integral tubular structures which include a helical or spiral perforation, groove, scoring, notch or other weakened or frangible structure which allows the core members to be pulled apart, stripped apart or unwound as if they were made from a helically or spirally wound web. In this regard, the cylindrical core members of the present invention can be considered (and are described herein) as being helically or spirally wound webs which are joined along their edges by the weakened or frangible structures. The cylindrical core members can be fabricated by molding or tooling the weakened or frangible helical or spiral structure into the walls of the cylindrical core members.

In another embodiment, the cylindrical core members can comprise helically or spirally wound web elements that are held in a tubular form by the annular sealing member.

In yet another embodiment of the present invention, the cylindrical core members can be provided with a pair or more of grooves, perforations or other weakened or frangible structures which extend axially and which can be parallel or non-parallel to one another. In this embodiment, one or more longitudinal web strips can be pulled internally from the cylindrical core members to relieve radial pressure or compression acting or the annular sealing members and allow the cylindrical core members to be removed.

Due to the manner in which the cylindrical core members are pulled apart, striped or unwound to effect removal of the closures of the present invention, the closures have an inherent tamper-evident characteristic which can be an important safety factor.

The cylindrical core members can be made from various plastic materials such as polyvinyl chloride, nylons, fluorocarbons, polypropylene and others. The cylindrical shape of the core members enable these members to withstand or support large radial forces, due to the manner in which such forces are evenly distributed around the core members. Thus, as will be understood from the following description of the invention, the cylindrical core members can be suitable thin-walled, thereby enabling them to be easily pulled or torn apart along their frangible structures.

The annular sealing members provide a seal between the cylindrical core members and the inner surface of a receptacle or container which is sealed by the closures of the present invention. The annular sealing members are compressed or pressed into a sealing relationship with the inner surface of a receptacle or container by the cylindrical core members. In this regard, the closures of the present invention can pressed into an opening of a receptacle or container, e.g. a bottle, in much the same way that a conventional cork or stopper is pressed into the opening in a neck of a bottle or similar receptacle or container. Once the closures of the present invention are pressed into a receptacle or container, the cylindrical core members ensure that the compressive sealing forces of the annular sealing members are maintained against the inner surfaces of the receptacle or containers.

The annular sealing members can comprise any suitable material which is sufficiently compressible to create a seal between the cylindrical core members and the inner surface of a receptacle or container. Suitable materials from which to manufacture the annular sealing members include, cork, buna rubber, butyl-nitrile rubber, chlorosulfonated polyethylene, cork filled rubbers, ENBR, EPDM, EPR, ethylene acetate copolymers, fluorocarbon polymers such as Vikon, hydrin rubbers, hydrogenated nitrile rubber, nitrile rubber, natural rubber, neoprene rubber, polyacrylates, polynorborene, polyurethane, silicon, styrenebutadiene rubber, Teflon, and similar materials. According to one embodiment of the present invention, the annular sealing members can made from cork and have the appearance of conventional wine corks.

According to one embodiment of the present invention, the annular sealing members can be coupled or partially coupled to the cylindrical core members so that the annular sealing members are removed from a receptacle or container as one cylindrical core members are pulled apart, stripped or unwound and removed from the receptacles containers. According to another embodiment of the present invention, the annular sealing members are not supplied to the cylindrical core members, so that the cylindrical core members can be pulled apart, stripped or unwound and removed from the receptacles or containers independantly of the annular sealing members. In this embodiment, the annular sealing members can be easily removed once they are no longer radially supported by the (removed cylindrical core members.

The coupling of the annular sealing members to the cylindrical core members can be accomplished using suitable adhesives, thermal bonding, or by manufacturing the annular sealing members from a resinous, elastomeric, or polymeric material which is coated on the outer surface of the cylindrical core members.

Figure 2:
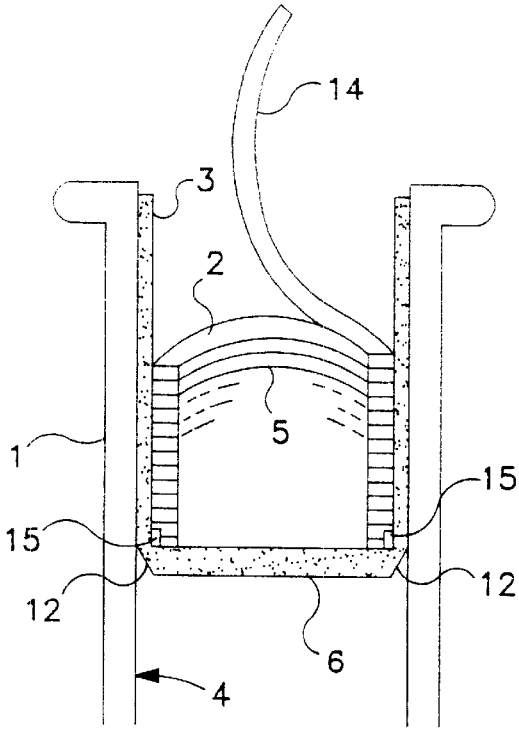
FIG. 2 is a partial perspective view of the closure of FIG. 1 which depicts how the cylindrical core member is pulled, stripped or unwound to remove the closure.

FIG. 1 is cross-sectional view of a closure according to one embodiment of the present invention. In FIG. 1 the closure is depicted as being positioned in the neck of a bottle 1. The closure includes a cylindrical core member 2 and an annular sealing member 3. As depicted in FIG. 1, the annular sealing member 3 is positioned between the inner surface 4 of the bottle 1 and the cylindrical core member 2. The sealing member 3 is preferably compressed between the inner surface 4 of the bottle 1 and the cylindrical core member 2 to provide a seal therebetween. The cylindrical core member 2 includes a helical or spiral perforation, groove, or other weakened or frangible structure generally identified by reference numeral 5. This frangible structure 5 allows the cylindrical core members to be pulled apart as if they were helically or spirally wound webs (as depicted in FIG. 2).

In the embodiment of the invention depicted in FIG. 1 the closure includes a bottom 6 which is integral with the annular sealing member 3. Also in this embodiment, the closure is provided with a cover or top 7 which is integral with the cylindrical core member 2. The top 7 can be grasped, lifted from the mouth of the bottle 1 and used to pull apart, strip or unwind the cylindrical core member 2. The top 7 can include a perforated tab 8, opening, or other structure by which one can lift the top 7 from the mouth of the bottle 1. Although the top 7 is shown as fitting in the mouth of bottle 1, it is possible to use a top which extends above the mouth of the bottle or one which even extends partially over the sides of the bottle.

According to one embodiment of the present invention, the cylindrical core member 2 is removed and separated from the annular sealing member 3, by grasping a leading end of the helically or spirally wound web that makes up the cylindrical core member 2. In the embodiment of the invention depicted in FIG. 1, the top 7 of the closure is connected to the leading end of the helically or spirally wound web at 9. Once the cylindrical core member 2 is removed, any compressive forces which the cylindrical core 2 maintained on the annular sealing member 3 are released and the annular sealing member 3 can be pulled out of the mouth of the bottle 1 with little resistance.

In the embodiment of the invention depicted in FIG. 1 a tab 10 is coupled to the bottom 6 of the annular sealing member 3 and can be used to pull the annular sealing member from the mouth of the bottle 1. Tab 10 can comprise an elongate strip or cord which can be rigid enough to extend towards the open end of annular sealing member 3. Otherwise, tab 10 can be a non-rigid strip, cord, etc., in which case the act of pulling, stripping or unwinding the cylindrical core member 2 would cause tab 10 to be pulled towards and out the open end of the annular sealing member 3.

Tab 10 is depicted as being anchored to the bottom 6 of the annular sealing member 3 by an anchor member 11 which extends through the bottom 6. Other manners of anchoring or coupling tab 10 to the bottom could be used, including gluing tab 10 to the bottom 6 of the annular sealing member 3 or embedding tab 10 into the bottom 6 of the annular sealing member 3.

In the embodiment of the invention depicted in FIG. 1, the bottom of the closure has a tapered portion 12 which rises above the lowest point 13 of the cylindrical core member 2. This configuration will ensure that all the compressive forces on the annular sealing member 3 are released once the cylindrical core member 2 is removed from the annular sealing member. While the use of a tapered portion 12 is useful for eliminating substantially all the compressive forces on the annular sealing member 3, it has been determined that there would not be sufficient compressive forces acting on the bottom 6 of the annular sealing member 3, absent a tapered portion 12 to prevent easy removal of the annular sealing member 3 once the cylindrical core member 2 is removed. Accordingly, the bottom 6 can be flat or curved.

In an alternative embodiment which can be similar to that depicted in FIG. 1, the lower portion of the cylindrical core 2 can be coupled to the annular sealing member 3 by a suitable adhesive, glue, etc. In this embodiment, as the bottom portion of the cylindrical core member 2 is pulled, stripped or unwound from the annular sealing member 3, the coupled, lower portion of the cylindrical core member 2 will pull out and remove the annular sealing member 3 from the mouth of the bottle 1, so that tab 10 will not be required.

It is noted that the embodiment of the invention depicted in FIG. 1 and similar embodiments which allow for the cylindrical core member 2 to be removed independently of the annular sealing member 3, will allow for the bottle 1 to be resealed by merely inserting a cylindrical element into the center of the (removed) annular sealing member 3 and reinserting the thus reinforced annular sealing member 3 into the opening of the bottle 1.

As discussed above, the annular sealing member can be made from various materials, including cork. The use of cork will give the closures of the present invention the appearance of conventional cork closures, which may be desirable when using the closures of the present invention for packaging wine. The closures of the present invention can be covered with a label or seal which will enhance the appearance of the closures, and the marketability of the products contained in the bottles, receptacles, containers, etc. Such labels can also include pictorial instructions regarding the operation, i.e., removal of the closures.

FIG. 2 is a partial perspective view of the closure of FIG. 1 which depicts how the cylindrical core member is pulled, stripped or unwound to remove the closure. In FIG. 2 the upper portion of the cylindrical core member 2 is depicted as being pulled apart, stripped or unwound, so that the web 14 of the cylindrical core member 2, which is otherwise maintained in a wound state by the weakened or frangible structure, can be seen in its unwound state. Arrow "a" illustrates the direction in which the lead end of the web 14 is pulled to remove the cylindrical core member 2 from the annular sealing member 3. In FIG. 2 the lower portion of the annular core member 2 is coupled to the annular sealing member 3 by a suitable adhesive 15, so that pulling the tailing end portion of web 14 from the annular sealing member 3 will effect removal of the annular sealing member 3. It is noted that the lead end of the web 14 does not have to be coupled to the cover or top 7 which is depicted in FIG. 1. In one alternative embodiment, the lead end of web 14 can merely extend radially inward or have a radially inwardly directed tab which can be grasped and pulled to remove the cylindrical core member 2. Such a structure can be covered by a separate cover or label which can be positioned in or above the mouth of the bottle, receptacle or container.

Figure 3:
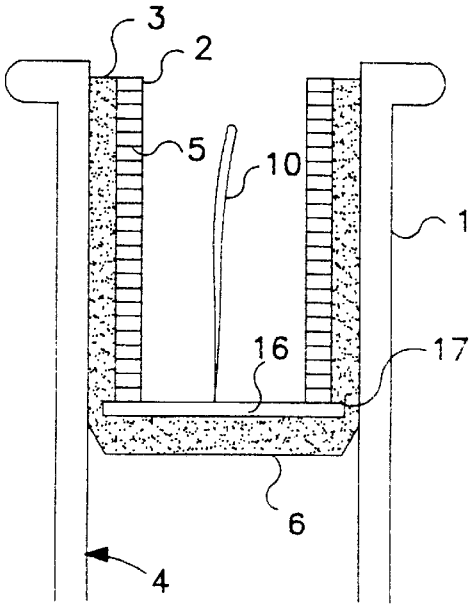
FIG. 3 is a cross-sectional view of an alternative embodiment of a closure according to the present invention.

FIG. 3 is a cross-sectional view of an alternative embodiment of a closure according to the present invention. In the embodiment of the invention depicted in FIG. 3, tab 10 is coupled to the bottom 6 of the annular sealing member 3 by means of an anchoring structure 16 which is structurally coupled in a groove 17 formed in the annular sealing member 3. In this embodiment, the tab 10 is coupled to the anchoring structure 16. In this embodiment, the anchoring structure 16 can comprise a disk or any suitable shaped structure.

Figure 4:
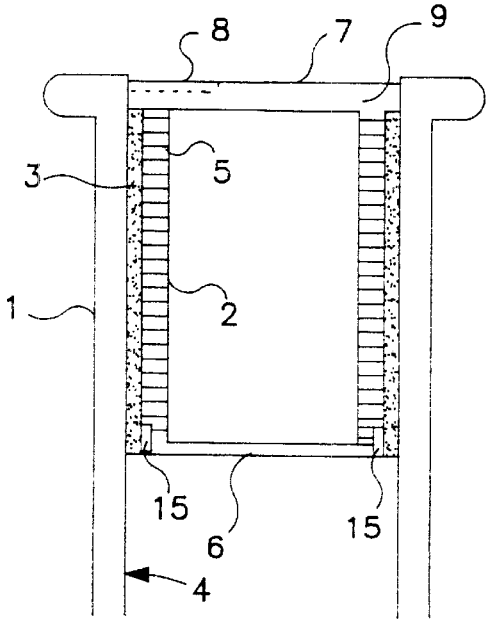
FIG. 4 is a cross-sectional view of a further alternative embodiment of a closure according to the present invention.

FIG. 4 is a cross-sectional view of a further alternative embodiment of a closure according to the present invention. In the embodiment of the invention depicted in FIG. 4, the bottom 6 of the closure is integrally formed at the lower portion of the cylindrical core member 2 or at the tailing end of the web 14 in a manner similar to how the top 7 is coupled to the upper portion of the annular core member (also depicted in FIG. 1). In this embodiment, the bottom 6 of the closure is removed after the cylindrical core member 2 is pulled apart, stripped or unwound, and as the tailing end of web 14 is pulled from the mouth of bottle 1. In this embodiment, an adhesive material 15 is provided at the lower portion of the cylindrical core 2 to effect removal of the annular sealing member 3, as discussed above.

Figure 5:
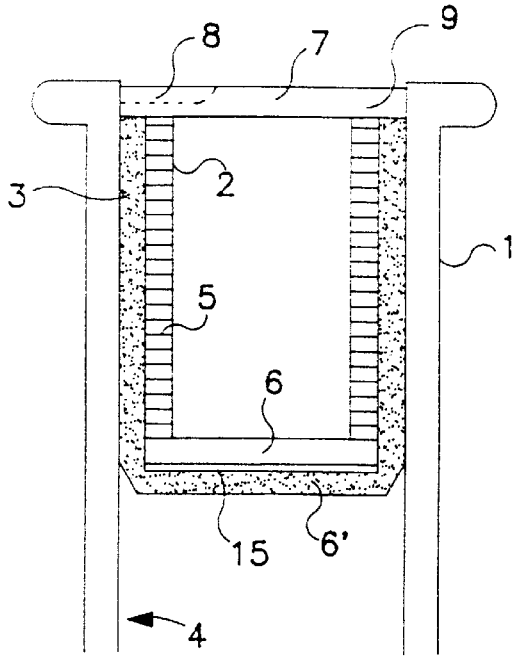
FIG. 5 is a cross-sectional view of a further alternative embodiment of a closure according to the present invention.

FIG. 5 is a cross-sectional view of a further alternative embodiment of a closure according to the present invention. The embodiment of the invention depicted in FIG. 5 is similar to that depicted in FIG. 4, the difference being that in FIG. 5 the annular sealing member 3 includes a bottom 6' which extends beneath the bottom 6 of the cylindrical core member 2. In this embodiment, an adhesive layer 15 is provided between the bottom of the annular sealing member 3 and the bottom of the cylindrical core member 2, so that as the bottom of the cylindrical core member 2 is removed, i.e. pulled from the mouth of bottle 1, the annular sealing member 3 is also removed.

Figure 6:
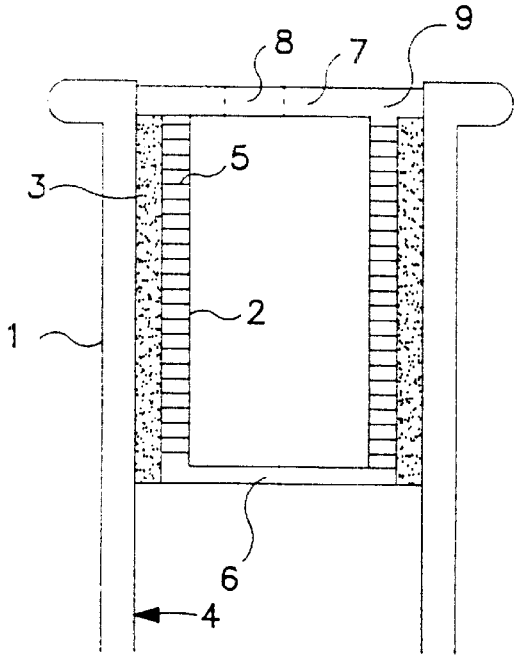
FIG. 6 is a cross-sectional view of a further alternative embodiment of a closure according to the present invention.

FIG. 6 is a cross-sectional view of a further alternative embodiment of a closure according to the present invention. The closure of FIG. 6 includes a cylindrical core member 2 which is similar to that discussed above and an annular sealing member 3 which is coupled to the outer peripheral surface of the cylindrical core member 2. For example, in this embodiment of the invention, the annular sealing member 3 can comprise a resinous, elastomeric, or polymeric material which is coated on the outer peripheral surface of the cylindrical core member 2. Such coating can be accomplished by dipping the cylindrical core member 2 in an uncured resin or polymeric composition and thereafter curing the same to form a compressible sealing element which is bonded to the cylindrical core member 2. In this embodiment, as the cylindrical core member 2 is pulled apart, stripped or unwound, the annular sealing member 3 bonded thereto is also pulled apart, stripped or torn and removed. Suitable materials from which the annular sealing member 3 can be fabricated in this embodiment include polymerizable, curable or moldable materials including those listed above and similar materials which demonstrate sufficient compressible characteristics for purposes of forming a seal and which can be torn by relatively moderate sheer forces. These materials can be applied by conventional coating techniques, including dipping, spraying, brushing, etc. It is possible to form a helical or spiral perforation, groove, or other weakened or frangible structure on or in the annular sealing members 3 and thereby use a sealing material which would be otherwise less subject to being pulled apart, stripped or torn.

Figure 7:
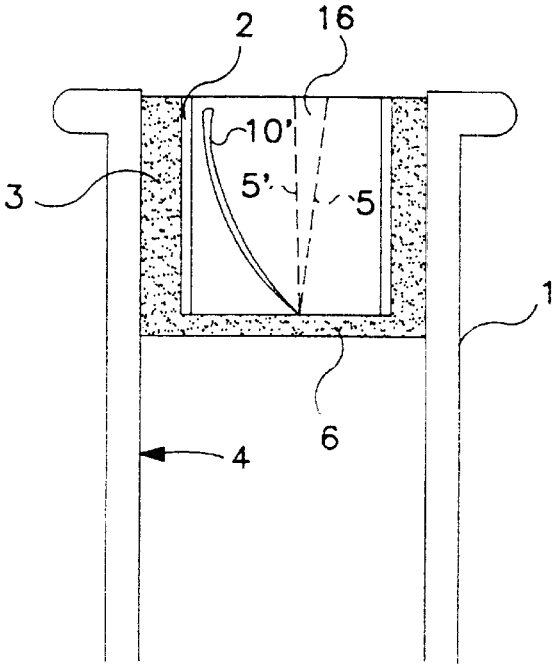
FIG. 7 is a cross-sectional view of a further alternative embodiment of a closure according to the present invention.

FIG. 7 is a cross-sectional view of a further alternative embodiment of a closure according to the present invention. In FIG. 7 the cylindrical core member 2 is provided with a pair of frangible structures 5' which define a web 16 that can be striped or pulled from the side of the cylindrical core member 2. In this embodiment a pull tab 10' is connected to the bottom of the web 16 to allow it to be pulled from the bottom up. The tapering of the side edges of the web 16 will allow it to gradually relieve radial forces as it is torn from the side of the cylindrical core member.

The closures of the present invention can be used in conjunction with a variety of products including, but not limited to wines and other beverages, medical and laboratory materials, food products, etc. The materials from which the annular sealing member 3 is made should be compatible with a desired use, e.g. non-toxic, non-reactive, inert, etc. Likewise, the materials from which the cylindrical core member 2 is made should be compatible with a desired use.

The closures of the present invention are compatible with conventional bottling techniques which compress and press corks, stoppers and similar closures into bottles, receptacles, containers.

A significant advantage of the closures of the present invention is that they an be removed without the need for auxiliary tools such as corkscrews. Thus, products which are packaged and sealed by the closures of the present invention, such as for example wine, can be opened easily at picnics, and other events or locations wherein opening tools such corkscrews may not be available. It is believed that the closures of the present invention can be manufactured so as to have the appearance of conventional wine corks, and thus, in addition to reducing the use of cork, will be readily accepted by wine consumers.

Another advantage of the closures of the present invention which relates to safety is that due to the manner in which the cylindrical core members are pulled apart, striped or unwound to effect removal of the closures of the present invention, the closures have an inherent tamper-evident characteristic which can be an important safety factor.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as set forth in the following claims.

What is claimed is:

1. A closure for receptacles which comprises:

a core member which comprises a cylindrical wall, a circular cross-section and at least one solid end defining a structure that extends continuously across the circular cross-section of the core member;

a groove provided in the cylindrical wall so as to define a weakened portion in the cylindrical wall adjacent a bottom of the groove along which weakened portion the core member can be easily torn; and an annular sealing member which surrounds the core member.

2. A closure for receptacles according to claim 1, wherein the weakened portion has a spiral shape.

3. A closure for receptacles according to claim 1, wherein a closed bottom is formed the annular sealing member.

4. A closure for receptacles according to claim 3, wherein a pull tab is coupled to the closed bottom of the annular sealing member.

5. A closure for receptacles according to claim 1, wherein the annular sealing member comprises a coating that is applied on the core member.

6. A closure for receptacles according to claim 5, wherein the annular sealing member is bonded to the core member.

7. A closure for receptacles according to claim 6, wherein the annular sealing member is integral with the core member.

8. A closure for receptacles according to claim 1, further comprising a top which is coupled to the core member.

9. A closure for receptacles which comprises:

a core member which comprises a cylindrical wall, a circular cross-section and at least one solid end defining a structure that extends continuously across the circular cross-section of the core member;

a pair of grooves provided in the cylindrical wall which pair of grooves form weakened portions in the cylindrical wall adjacent bottoms of said pair of grooves, along which weakened portions the core member can be easily torn, said pair of grooves define side edges of a web that can be pulled from a side of the cylindrical member; and an annular sealing member which surrounds the core member.

10. A closure for receptacles according to claim 9, wherein the side edges of the web have non-parallel side edges.

11. A method of removing a closure from a receptacle which comprises:

providing a receptacle which is sealed with a closure having a core member and an annular sealing member, the core member comprising a cylindrical wall, a circular cross-section, at least one solid end defining a structure that extends continuously across the circular cross-section of the core member, and a groove provided in the cylindrical wall so as to define a weakened portion in the cylindrical wall adjacent a bottom of the groove along which weakened portion the core member can be easily torn;

pulling the cylindrical wall of the core member apart in a helical or spiral manner along the weakened portion to form an elongate web which is removed from the receptacle; and pulling the annular sealing member from the receptacle.

12. A method of removing a closure from a receptacle according to claim 11, wherein the step of pulling the annular sealing member from the receptacle is effected by pulling the core member from the receptacle.

13. A closure for receptacles which comprises:

a cylindrical member that comprises a circular cross-section and at least one solid end defining a structure that extends continuously across the circular cross-section of the cylindrical member; and a groove provided in the cylindrical member so as to define a weakened portion in the cylindrical member adjacent a bottom of the groove along which weakened portion the cylindrical member can be easily torn when an end of the cylindrical member is pulled along an axis of the cylindrical member.

14. A closure for receptacles according to claim 13, wherein the weakened portion has a spiral shape.

15. A closure for receptacles according to claim 13, further comprising a tab coupled to an upper portion of the cylindrical member.

16. A method of removing a closure from a receptacle which comprises:

providing a receptacle which is sealed with a closure having a cylindrical member, the cylindrical member comprising a circular cross-section and at least one solid end defining a structure that extends continuously across the circular cross-section of the cylindrical member and a groove provided in the cylindrical member so as to define a weakened portion in the cylindrical member adjacent a bottom of the groove along which weakened portion the cylindrical member can be easily torn; and pulling on an end of the cylindrical member to tear it along the weakened portion while removing it from the receptacle.

17. A method of removing a closure from a receptacle according to claim 16, wherein the receptacle is a bottle.

* * * * *